US006253474B1

(12) United States Patent
Kramer

(10) Patent No.: US 6,253,474 B1
(45) Date of Patent: Jul. 3, 2001

(54) MOVING APPARATUS FOR DECORATING

(75) Inventor: Hermann Kramer, Geisingen (DE)

(73) Assignee: Stefan Jud, Geisingen (DE)

( * ) Notice: Subject to any disclaimer, the term of this patent is extended or adjusted under 35 U.S.C. 154(b) by 0 days.

(21) Appl. No.: 09/180,454

(22) PCT Filed: May 7, 1997

(86) PCT No.: PCT/DE97/00964

§ 371 Date: Nov. 6, 1998

§ 102(e) Date: Nov. 6, 1998

(87) PCT Pub. No.: WO97/42619

PCT Pub. Date: Nov. 13, 1997

(30) Foreign Application Priority Data

Apr. 8, 1996 (DE) ..... 196 18 464

(51) Int. Cl.[7] ..... G09F 19/00
(52) U.S. Cl. ..... 40/430; 74/89.17
(58) Field of Search ..... 40/430, 433, 429, 40/431; 74/89.17, 51, 49

(56) References Cited

U.S. PATENT DOCUMENTS 3,012,448 * 12/1961 Abraham ..... 74/89.17
4,557,657 * 12/1985 Olson et al. ..... 74/89.17
5,018,288 5/1991 Yang .

FOREIGN PATENT DOCUMENTS 2636564 3/1990 (FR) .

* cited by examiner

*Primary Examiner*—Cassandra H. Davis
(74) *Attorney, Agent, or Firm*—Gudrun E. Huckett

(57) ABSTRACT

A motion apparatus for decorative purposes has a rotary motion having at least two rotors movement-coupled to one another and each having an axis of rotation. The rotors each have a rotary base element coupled to one another and rotating synchronously at identical angular speed about their axis of rotation. Each rotor has a securing arm extending at a right angle to the axis of rotation and further has a radially outer front end. The securing arms are moveable in a longitudinal direction of the securing arm perpendicular to the axis of rotation, wherein movement of the securing arms in the longitudinal direction is coupled to the rotation of the rotary base elements such that for a complete rotation of the securing arms the front ends of the securing arms describe a spiral path. Neighboring securing arms are displaced by 180° to one another so as to have a collinear position in which the front ends point toward one another and in which the securing arms have been moved in the same direction into a longitudinal end position. A body is secured to the front end of one of the securing arms and transferred in the collinear position to the front end of the other securing arm. A drive for driving the rotary motion is provided.

8 Claims, 1 Drawing Sheet

MOVING APPARATUS FOR DECORATING

BACKGROUND OF THE INVENTION

The invention relates to a motion apparatus for decorative purposes.

The object and purpose of the inventive motion apparatus is to provide a motion structure which for decorative purposes or for other purposes can be placed into a room or can also be placed outdoors. It has a similar purpose as, for example, a mobile.

The invention has the object to provide a motion apparatus for decorative purposes.

SUMMARY OF THE INVENTION

The technical solution is characterized by a rotary motion with at least two movement-coupled rotors, each rotor provided with a rotary base element whereby the rotary base elements of neighboring rotors are rotationally coupled synchronously with identical angular speed as well as provided with a longitudinally moveable securing arm arranged substantially perpendicularly to the axis of rotation of the corresponding rotary base element and rotating about the axis of rotation, whereby the securing arms of the rotors are longitudinally moveably coupled such to the rotational movements of the rotary base elements that for a complete revolution of the securing arm its front end is moved along a spiral path, whereby the securing arms of neighboring rotors are displaced relative to one another by 180° such that they have a collinear position in which the front ends face one another and in which the two securing arms are moved in the same direction into a respective end position. The apparatus further comprises a body, secured at the front end of the securing arm of one of the rotors and in the collinearly aligned position transferred to the securing arm of the other rotor, and further comprises also a drive unit for the rotary motion.

Accordingly, a motion apparatus for decorative purposes is provided which exhibits a harmonic movement of the rotary motion as well as of the body. The basic idea is that the body is transferred alternatingly from one rotor to the other rotor. After the transfer of the body the received body, due to the longitudinal movement of the securing arm, performs a spiral movement whereby after one complete revolution the securing arm is extended such that it can transfer the body to the retracted securing arm of the other rotor. The body thus follows the path of a figure eight. This produces a harmonic movement with constant transfer of the body. The transfer of the body from one securing arm to the other can be achieved with a corresponding coupling device which can be, for example, controlled by the rotational movement of the rotor. The transfer or coupling device can be embodied by solenoids at the two arms which are switched accordingly, or by grippers, for example, tongs controlled by control curves, or a receiving nipple using control curves. Other devices are, of course, also possible. In the basic design of the motion apparatus two rotors are provided. However, it is also possible, to provide three rotors in order to reduce imbalance so that two bodies must then be provided whereby, of course, the movements of the three rotors must be matched with respect to the two bodies and whereby two rotors respectively form a rotor pair.

In one further embodiment it is suggested that the rotary base elements rotate in opposite directions. Accordingly, the securing arms also rotate in opposite directions.

Preferably, the rotary base elements are meshing gearwheels. The gear wheels of the rotors engage one another and produce thus in a simple manner the opposed movement of the rotary base elements. When employing an intermediate gear wheel, it is, of course, possible to have the two base elements rotate in the same direction.

A further embodiment suggests that each rotary base element has coordinated therewith a longitudinally moveable rod arranged along the axis of rotation which is in cooperation with the securing arm such that a longitudinal movement of the rod results in longitudinal movement of the securing arm. This provides for a simple realization for reciprocating the securing arms during the rotational movement. For example, the rod may be a toothed rod which cooperates with a gear wheel and this gear wheel cooperates with the securing arm which is also a toothed rod.

A further embodiment suggests a crankshaft for driving the rods with corresponding cranks for movement of the rods whereby the crankshaft is synchronized by an intermediate gear box with the rotary base elements. This is a simple embodiment in order to reciprocate vertically the rods whereby for all rotors a common crankshaft is provided and whereby the respective rods are connected to respective cranks. Such a crankshaft provides for a simple synchronization of the rotary base elements.

Instead of the disclosed mechanism for reciprocating the securing arms it is also possible to employ instead a lever arrangement which transforms the rotational movement of the base elements into a linear movement of the securing arm.

A further embodiment suggests that the securing arm is arranged on an auxiliary rotary element that is coaxial to the rotary base element. This provides a simple technical solution in order to support and guide the securing arms of the respective rotors in a simple manner.

A further embodiment suggests that the auxiliary rotary element can be decoupled from the rotary base element such that the auxiliary rotary element together with its securing arm can advance for a short period of time relative to the rotary base element. This provides for an additional movement variation by providing decoupling of the movement.

Finally, in another embodiment it is suggested that the drive acts on one of the base rotary elements. This drive has the function to maintain the entire motion apparatus in motion. Of course, it is also possible to actuate the drive only for a certain period of time and then leave the motion apparatus to continue to move on its own. Of course, after a certain amount of time it will stop moving so that the drive must be actuated again. In order to maintain the movement for an extended period of time while the drive unit is turned off, it is possible to employ a flywheel.

BRIEF DESCRIPTION OF THE DRAWINGS

One embodiment of the inventive motion apparatus for decorative purposes will be disclosed in the following with the aid of the drawings. It is shown in.

DESCRIPTION OF PREFERRED EMBODIMENTS

Figure 1:
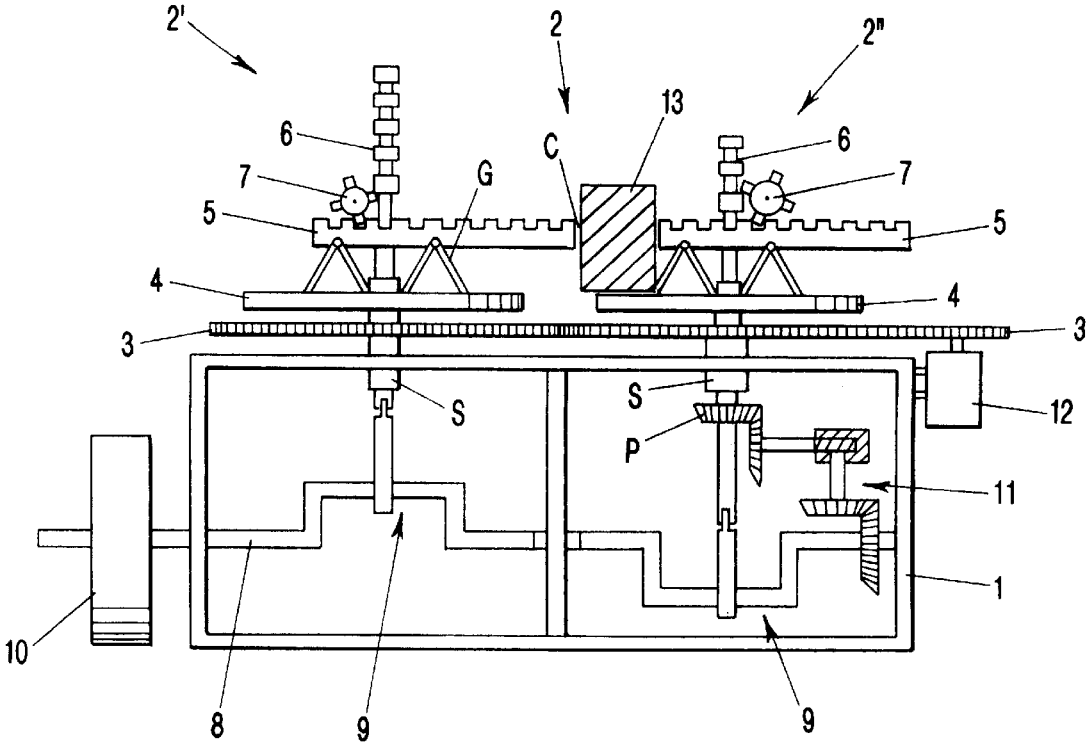
FIG. 1 a schematic view of the motion apparatus.

The motion apparatus has a housing 1 having a rotary motion 2 arranged at its upper side. It is comprised of two rotors 2', 2". The two rotors 2', 2" are identical in their basic construction.

Each rotor 2', 2" comprises a rotary base element in the form of a gear wheel 3 whereby the two gear wheels 3 of the two rotors 2', 2" mesh with one another. Above the gear wheel 3 an auxiliary rotary element in the form of a mass disk 4 is arranged. This mass disk 4 is also rotatable about the axis of rotation A of the gear wheel 3 whereby the rotational movement of the gear wheel 3 and the mass disk 4 are coupled to one another or decoupled. A securing arm 5 is supported longitudinally slidably on guides G on the mass disk 4 on a frame structure whereby the securing arm 5 is substantially intercepts the axis of rotation A. Along the axis of rotation A a rod 6 is provided which is embodied as a toothed rod. This rod 6 is connected to a pinion 7 supported on a pinion support PS on the mass disk which actuates the securing arm 5 embodied as a toothed rod for this purpose.

Within the housing 1 a crankshaft 8 with two cranks 9 is provided. A respective rod 6 of the two rotors 2', 2" is rotatably connected to the cranks 9. A flywheel 10 is shown schematically external to the housing 1. Furthermore, the crankshaft 8 is connected by intermediate gear box 11 to the right gear wheel 3. Finally, a drive unit 12 is arranged external to the housing 1 whereby the drive is, for example, an electric motor and is connected by a pinion D to the gear wheel 3 having a sleeve S with a pinion P connected thereto that is in driving connection with the gear box. Finally, it is shown that to the front end of one rotor 2' a body 13 is coupled by a coupling member C".

The motion apparatus functions as follows:

The drive unit 12 rotates the two gear wheels 3 in opposite directions. Since the right gear wheel 3 is an active connection with the intermediate gear box 11, the crankshaft 8 is rotated at the same time . This rotation of the crankshaft 8 moves the two rods 6 alternatingly upwardly and downwardly in the sleeve S. This movement of the rods 6 displaces the securing arms 5 by the pinion 7, as can be seen especially in the positions of the two securing arms 5 shown in the drawings in comparison to the position of the two rods 6.

Figure 2:
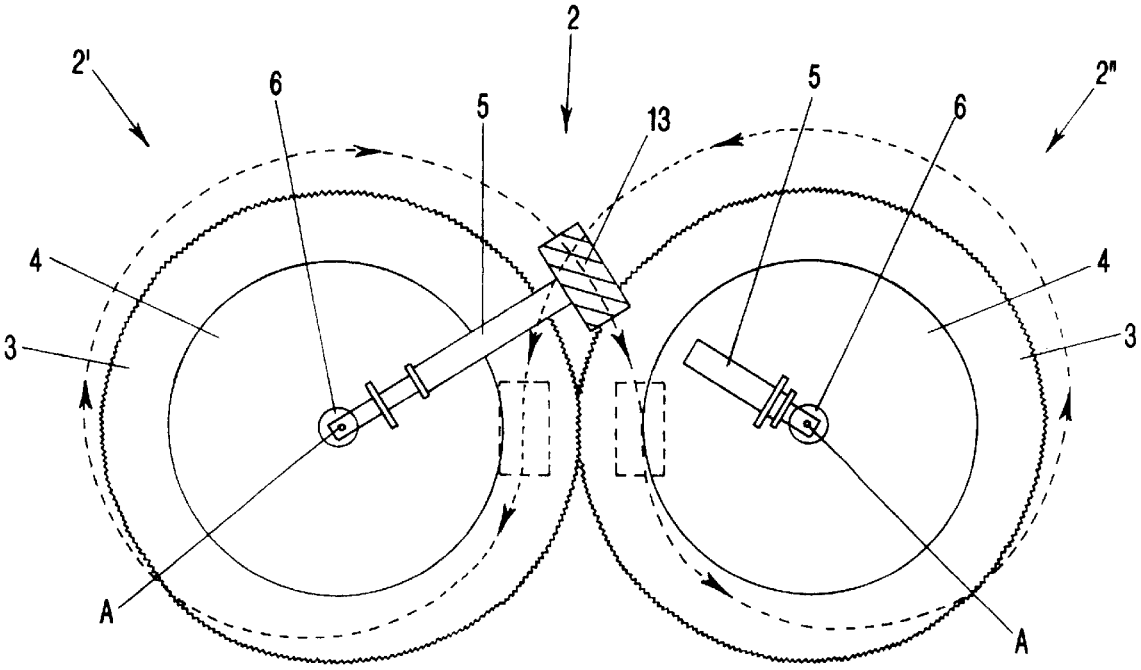
FIG. 2 a plan view of an alternative to the motion apparatus in FIG. 1 whereby the movement path of the body is shown.

FIG. 2 shows that the body 13 is coupled to the front end of the securing arm 5 of the left rotor 2'. The securing arm 5 performs a rotary motion in the direction of the arrow so that finally the body 13 reaches the rectangular position shown in dashed lines. In this position, the securing arm 5 of the right rotor 2" has moved in the clockwise direction by the same angular distance so that the two securing arms 5 are exactly positioned opposite one another. The securing arm 5 of the right rotor 2" is in its retracted position. In this position, the securing arm 5 of the right rotor 2" can couple the body 13 thereto whereby the body 13 at the same time is disengaged from the securing arm 5 of the left rotor 2'.

Upon further rotation of the right securing arm 5, the corresponding rod 6 is moved upwardly and moves the securing arm 5 radially forwardly so that the body 13 follows a spiral path. Upon a complete rotation the body 13 is then in the left rectangular position shown in dashed lines in FIG. 2. In this position the securing arm 5 of the left rotor 2' is retracted and the body 13 can be coupled thereto and the right securing arm 5 can release the body 13. Since now the left securing arm 5 has received the body 13, it again follows a spiral path according to the left loop shown in FIG. 2 until the body 13 and thus the entire system have reached their initial position. Thus, a continuous change of the body 13 between the rotor 2' and the other rotor 2" and vice versa takes place.

The intermediate gear box 11 ensures that the rotary motion 2 rotates with twice the speed of the crankshaft 8 and that the two securing arms 5 at the point of transfer of the body 13 are positioned opposite one another when the crankshaft 8 is positioned at its lower or upper dead center. Furthermore, it is provided that the mass disks 4 with their securing arms 5 can be briefly decoupled from the gear wheels 3 so that a relative advancing movement between the gear wheel 3 and the mass disk 4 with its securing arm 5 is possible.

In the shown embodiment two rotors 2', 2" are provided. Of course, it is also possible to provide three rotors with two bodies, for example, in order to reduce imbalance of the system.

The present invention is, of course, in no way restricted to the specific disclosure of the specification and drawings, but also encompasses any modifications within the scope of the appended claims.

What is claimed is:

1. A motion apparatus for decorative purposes, said apparatus comprising:

a rotary motion (2) having at least two rotors (2', 2") movement-coupled to one another and each having an axis of rotation (A);

each one of said rotors (2', 2") having a rotary base element (3);

said rotary base elements (3) coupled to one another and rotating synchronously at identical angular speed about said axis of rotation;

each one of said rotors (2', 2") having a securing arm (5) extending at a right angle to said axis of rotation (5) and having a radially outer front end;

said securing arms (5) moveable on guides mounted on said rotors in a longitudinal direction of said securing arm (5) perpendicular to said axis of rotation (5), wherein movement of said securing arms (5) in said longitudinal direction is coupled to the rotation of said rotary base elements (3) such that for a complete rotation of said securing arms (5) said front ends of said securing arms (5) describe a spiral path;

wherein said securing arms (5) are displaced by 180° to one another so as to have a collinear position in which said front ends point toward one another and in which said securing arms (5) have been moved in the same direction into a longitudinal end position;

a body (13) secured to said front end of one of said securing arms (5) and transferred in said collinear position to said front end of the other one of said securing arms (5);

a drive (12) for driving said rotary motion (2).

2. A motion apparatus according to claim 1, wherein said rotary base elements (3) rotate in opposite directions.

3. A motion apparatus according to claim 1, wherein said rotary base elements (3) are meshing gear wheels.

4. A motion apparatus according to claim 1, wherein each one of said rotors (2', 2") has a rod (6) extending coaxially to said axis of rotation (A) and is moveable along said axis of rotation (A), said rod (6) cooperating with said securing arm (5) such that upon movement of said rod (6) along said axis of rotation (A) said securing arm (5) is moved in said longitudinal direction.

5. A motion apparatus according to claim 4, further comprising:

a crankshaft (8) having cranks (9);

a gear box (1) connected to said crankshaft (8);

wherein said rods (6) are connected to said cranks (9);

wherein rotation of said crankshaft (8) moves said rods (6) along said axis of rotation (A); and wherein said crankshaft (8) is synchronized with said rotary base elements (3) by said gear box (11).

6. A motion apparatus according to claim 1, wherein each one of said rotors (2', 2") has an auxiliary rotary element (4) arranged coaxially to said rotary base element (3) and wherein said securing arm (5) is connected to said auxiliary rotary element (4).

7. A motion apparatus according to claim 6, wherein said auxiliary rotary element (4) and said rotary base element (3) are disengageable from one another such that said auxiliary rotary element (4) and said securing arm (5) advance relative to said rotary base element (3) when said auxiliary rotary element (4) and said rotary base element (3) are disengaged.

8. A motion apparatus according to claim 1, wherein said drive (12) drives one of said rotary base elements (3).

* * * * *

UNITED STATES PATENT AND TRADEMARK OFFICE

CERTIFICATE OF CORRECTION

PATENT NO. : 6,253,474 B1
DATED : July 3, 2001
INVENTOR(S) : Hermann Kramer

It is certified that error appears in the above-identified patent and that said Letters Patent is hereby corrected as shown below:

Title page,
Foreign Application Priority Data, the date reading "Apr. 8, 1996" should read -- May 8, 1996 --.

Signed and Sealed this

First Day of January, 2002

*Attest:*

*Attesting Officer*

JAMES E. ROGAN
*Director of the United States Patent and Trademark Office*